US012560338B2

(12) United States Patent
Kim et al.

(10) Patent No.: US 12,560,338 B2
(45) Date of Patent: Feb. 24, 2026

(54) AIR CONDITIONING SYSTEM USING HEAT PUMP AND AIR HEATING DEVICE

(71) Applicant: KYUNGDONG NAVIEN CO., LTD., Gyeonggi-do (KR)

(72) Inventors: Dong Hwan Kim, Seoul (KR); Kyung Chang Jang, Seoul (KR)

(73) Assignee: KYUNGDONG NAVIEN CO., LTD., Gyeonggi-do (KR)

( * ) Notice: Subject to any disclaimer, the term of this patent is extended or adjusted under 35 U.S.C. 154(b) by 147 days.

(21) Appl. No.: 18/512,482

(22) Filed: Nov. 17, 2023

(65) Prior Publication Data

US 2024/0210043 A1 Jun. 27, 2024

(30) Foreign Application Priority Data

Dec. 26, 2022 (KR) ..... 10-2022-0184284
Dec. 26, 2022 (KR) ..... 10-2022-0184285

(51) Int. Cl.

| | |
|---|---|
| ***F24D 3/02*** | (2006.01) |
| ***F24D 3/18*** | (2006.01) |
| ***F24D 5/12*** | (2006.01) |
| ***F24D 15/04*** | (2006.01) |
| ***F24F 5/00*** | (2006.01) |
| ***F24H 1/00*** | (2022.01) |
| ***F24H 6/00*** | (2022.01) |
| ***F25B 47/02*** | (2006.01) |

(52) U.S. Cl.

CPC ..... *F24D 3/02* (2013.01); *F24D 3/18* (2013.01); *F24D 5/12* (2013.01); *F24D 15/04* (2013.01); *F24F 5/0096* (2013.01); *F24H 1/0027* (2013.01); *F24H 6/00* (2013.01); *F25B 47/025* (2013.01)

(58) Field of Classification Search

CPC ..... F24D 3/02; F24D 3/18; F24D 5/12; F24D 11/02; F24D 12/02; F24D 15/04; F24D 17/02; F24H 6/00

See application file for complete search history.

(56) References Cited

U.S. PATENT DOCUMENTS 5,558,273 A * 9/1996 Swenson ..... F28D 1/06 165/104.19
10,132,507 B2 * 11/2018 Deivasigamani ... F24D 19/0092

* cited by examiner

*Primary Examiner* — Christopher R Zerphey
(74) *Attorney, Agent, or Firm* — McDonald Hopkins LLC

(57) ABSTRACT

Provided is an air conditioning system. The air conditioning system includes a heat pump provided to heat or cool a circulating refrigerant, an air heating device provided to burn a fuel so as to heat circulating water so that air is heated by the heated water, and an intermediate heat exchanger provided to exchange heat between the refrigerant and the water.

16 Claims, 4 Drawing Sheets

AIR CONDITIONING SYSTEM USING HEAT PUMP AND AIR HEATING DEVICE

CROSS-REFERENCE TO RELATED APPLICATIONS

This application claims the priority of Korean Patent Application Nos. 10-2022-0184284 filed on Dec. 26, 2022, and 10-2022-0184285 filed on Dec. 26, 2022, in the Korean Intellectual Property Office, the disclosures of which are incorporated herein by reference in their entireties.

BACKGROUND OF THE INVENTION

Field of the Invention

The present invention relates to an air conditioning system using a heat pump and an air heating device.

Description of the Related Art

FIG. 1 is a conceptual view of an existing integrated cooling and heating system that is mainly used in North America. The existing integrated heating and cooling system that is mainly used in North America may be mainly used as an air handler that cools air supplied to each room through heat transfer using and A-coil and a heat pump HP that is an outdoor unit and heats the air supplied to each room through heat transfer using a gas/air heating device or transfers heat by circulating a refrigerant using electrical power and further uses an electric device. The air coil, the gas/air heating device, and the air conditioner are an indoor air heating device IH disposed inside the house H. The gas/air heating device may operate by burning a gas as fuel and transferring heat generated from the gas to air. The heat pump HP may operate by receiving electric power and circulating the refrigerant using the electric power as power.

The heat pump HP may operate in a refrigeration mode by circulating the refrigerant through a refrigeration cycle of compression—condensation—expansion—evaporation. Among these, heat absorption, i.e., cooling may be performed, and the heat absorbed by the refrigerant may be dissipated at a portion at which the condensation occurs. However, when the refrigerant is reversely circulated in the heat pump HP, the portion at which the evaporation occurs and the portion at which the condensation occurs are reversed, and thus, the heat dissipation may occur at the portion at which the heat absorption occurs, resulting in heating rather than cooling.

Thus, in addition of the gas/air heating device, the heating may be performed by the heat pump HP. However, the heat pump HP disposed in the outdoor space may be exposed to a very low temperature environment, and thus, water vapor around the heat pump HP may be frozen to cause frost, and to remove the frost, the same defrost mode operation as the cooling operation as being opposed to the heating operation has to be performed. Depending on a defrost mode operation, the heated refrigerant may reach a portion of the heat pump HP exposed to the outdoor space.

When operating in the defrost mode, since the heat pump HP does not sufficiently perform the heating, a heating load that is burden by the gas/air heating device may increase, and a heating wire may be additionally used to burden a heating load of the existing heat pump HP.

When the defrost mode operation is completed, the heat pump HP may operate again for the heating. However, when switched from the defrost mode to the heating mode, residual heat applied by the existing gas/air heating device may further heat a high-temperature and high-pressure refrigerant circulated in the heat pump HP, and the overheated refrigerant may be transferred to a compressor including the heat pump HP to damage the heat pump HP.

In addition, when the heating wire is used instead of the heat pump HP, this is a merely a change in mean for heating, and thus there is a limitation in that uniform heating is difficult.

SUMMARY OF THE INVENTION

An aspect of the present invention provides an air conditioning system, which prevents a heat pump from being damaged and provides stable heating.

According to an aspect of the present invention, there is provided an air conditioning system including: a heat pump provided to heat or cool a circulating refrigerant; an air heating device provided to burn a fuel so as to heat circulating water so that air is heated by the heated water; and an intermediate heat exchanger provided to exchange heat between the refrigerant and the water.

According to another aspect of the present invention, there is provided an air conditioning system including: a heat pump provided to heat or cool a circulating refrigerant; an air heating device provided to burn a fuel so as to heat circulating water so that air is heated by the heated water; a furnace case provided with the air heating device; and an intermediate heat exchanger disposed outside the furnace case and provided to exchange heat between the refrigerant and the water.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
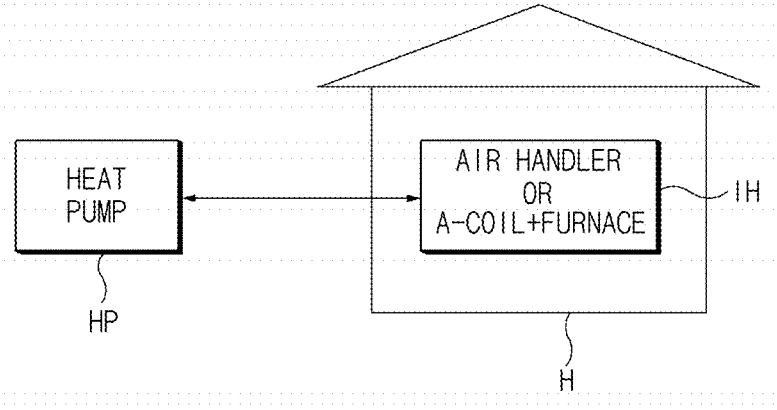
FIG. 1 is a conceptual view of an existing integrated cooling and heating system that is mainly used in North America.

Hereinafter, embodiments of the present invention will be described in detail with reference to the accompanying drawings. In adding of reference numerals to components of each drawing, it should be noted that the same components have the same numerals as much as possible even if the components are displayed on different drawings. In the following description of the present invention, a detailed description of known functions and configurations incorporated herein will be omitted to avoid making the subject matter of the present invention unclear.

Also, in the description of the embodiments of the present invention, the terms such as first, second, A, B, (a) and (b) may be used. These terms are only used to distinguish the component from other components, and the essence, sequence, or order of the corresponding component is not limited by the term. It should be understood that when an element is described as being "connected", communicated", "coupled", or "connected" to another element, the former may be directly connected or jointed to the latter or may be "connected", communicated", "coupled" or "connected" to the latter with a third component interposed therebetween.

Figure 2:
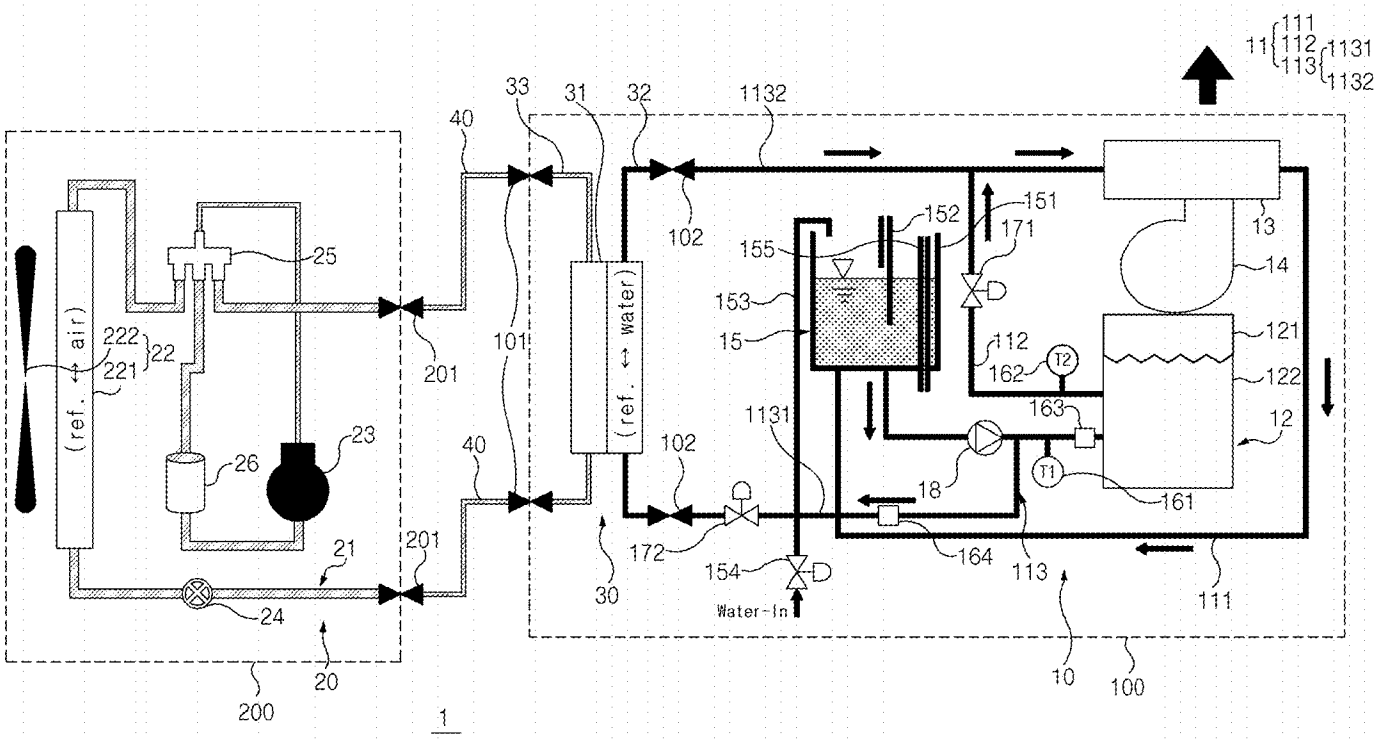
FIG. 2 is a conceptual view of an air conditioning system according to a first embodiment of the present invention.

FIG. 2 is a conceptual view of an air conditioning system 1 according to a first embodiment of the present invention.

Referring to the drawings, the air conditioning system 1 according to an embodiment of the present invention may include a heat pump 20, an air heating device 10, and an intermediate heat exchanger 30.

In the specification of the present invention, the expressions of upstream and downstream may be based on a flow direction of a fluid. For example, if the fluid flows from left to right, the left may correspond to the upstream, and the right may correspond to the downstream. In the specification of the present invention, a passage may refer to a portion through which a fluid such as water or a refrigerant flows and which is defined by a pipe or a soft hose. However, each of components connected to a pipe or a soft hose may also define the passage together.

Heat Pump (20)

The heat pump 20 may heat or cool a circulating refrigerant. In an embodiment of the present invention, the heat pump 20 may refer to a portion corresponding to an outdoor unit in a circuit in which the refrigerant is circulated.

The heat pump 20 may include a heat pump main passage 21. While the refrigerant flows through the heat pump main passage 21, a pressure may be changed, and heat exchange may be performed. When condensation of the refrigerant occurs in the intermediate heat exchanger 30 connected to the heat pump main passage 21, heating may be performed on air, and when evaporation occurs in the intermediate heat exchanger 30, cooling may be performed on air. When the heating is performed, at least one of the air heating device 10 or a heat pump 20 may operate for the heating, and when the cooling is performed, only a furnace fan 14 may operate in the air heating device 10, and the heat pump 20 may be operate for the cooling.

The heat pump 20 may include an expansion valve 24. The expansion valve 24 may serve as an expansion valve 24 that expands the refrigerant. The expansion valve 24 may be a thermostatic expansion valve 24, in which a degree of superheat of the refrigerant may be constantly maintained in a manner in which, when a degree of superheat of the refrigerant increases, the expansion valve 24 is opened, and when the degree of the superheat of the refrigerant decreases so that the refrigerant is saturated in the intermediate heat exchanger 30. The expansion valve 24 may be an electronic expansion valve 24 that electronically controls a flow rate. The expansion valve 24 may be disposed on at upstream side of the intermediate heat exchanger 30 and disposed at the downstream side of an outdoor heat exchange module 22, based on a refrigerant flow direction during the cooling. The expansion valve 24 may be opened or bypassed during the heating.

The heat pump 20 may include the outdoor heat exchange module 22. The outdoor heat exchange module 22 may be mainly disposed in the outdoor space to dissipate unnecessary heat by exchanging the refrigerant with the outside or absorb heat necessary for the indoor space.

The outdoor heat exchange module 22 may include an outdoor heat exchange part 221 for this functions. The outdoor heat exchange part 221 may be connected to the heat pump main passage 21 to allow the refrigerant to flow into the outdoor heat exchange part 221 so that the outdoor heat exchange part 221 serves as an evaporator when the heating is performed and serves as a condenser when the cooling is performed. When the refrigerant passing through the outdoor heat exchange part 221 performs the cooling, the refrigerant may be condensed to transfer latent heat to air passing around the outdoor heat exchange part 221. When the refrigerant passing through the outdoor heat exchange part 221 performs the heating, the refrigerant may be evaporated to take the heat out of the air passing around the outdoor heat exchange part 221. To enable smooth heat exchange, the outdoor heat exchange module 22 may include an outdoor fan 222 disposed around the outdoor heat exchange part 221. The outdoor fan 222 may rotate to generate a flow of air around the outdoor heat exchanger 221.

The heat pump 20 may include a compressor 23. The compressor 23 may be connected to the heat pump main passage 21 to receive and discharge the refrigerant and may serve to compress the passing refrigerant. The compressor 23 may operate by receiving power from an external power source or may operate by receiving power.

The heat pump 20 may include an accumulator 26. The accumulator 26 may phase-separate the passing refrigerant to transfer only a gaseous refrigerant to the compressor 23 or the outdoor heat exchange part 221.

The heat pump 20 may include a four-way valve 25. When the heating is performed, the four-way valve 25 may be configured so that the passage of the refrigerant is provided in a shape in which the refrigerant discharged from the outdoor heat exchange part 221 is introduced into the compressor 23 through the accumulator 26 to flow to the intermediate heat exchanger 30, or when the cooling is performed, the four-way valve 25 may be configured so that the passage of the refrigerant is provided in a shape in which the refrigerant discharged from the intermediate heat exchanger 30 is introduced into the compressor 23 through the accumulator 26 to flow to the outdoor heat exchanger 221.

That is, when the heating is performed, the refrigerant may be transferred from the intermediate heat exchanger 30 to the heat pump main passage 21 and sequentially pass from the heat pump main passage 21 to the expansion valve 24, the outdoor heat exchange part 221, the four-way valve 25, the accumulator 26, the compressor 23, and the four-way valve 25 so as to be heated and then be transferred again to the intermediate heat exchanger 30. When the cooling is performed, the refrigerant may be transferred from the intermediate heat exchanger 30 to the heat pump main passage 21 and sequentially pass from the heat pump main passage 21 to the four-way valve 25, the accumulator 26, the compressor 23, the four-way valve 25, the outdoor heat exchange part 221, and the expansion valve 24 so as to be cooled and then be transferred again to the intermediate heat exchanger 30.

Air Heating Device (10)

An air heating device 10 according to a first embodiment of the present invention is a device that heats circulating water by burning a fuel and heats air by the heated water. That is, unlike typical gas furnaces that directly heat air using a combustion gas, water may be used as a heat transfer medium.

An overall air heating mechanism performed in the air heating device 10 will be briefly described. When heating is performed, the air heating device 10 may heat water stored in an expansion tank 151 in a water heater 12 and then transfer the heated water to the air heat exchanger 13. The heated water transferred to the air heat exchanger 13 may heat air blown from a furnace fan 14, and then, the heated air may be transferred to each room. A furnace main passage 11 may connect the expansion tank 151, the water heater 12, and the air heat exchanger 13 to allow water to be circulated. Hereinafter, each component will be described in more detail. When cooling is performed, the air heating device 10 may transfer the water stored in the expansion tank 151 to the intermediate heat exchange part 31 so as to be cooled by the refrigerant, and the cooled water may be transferred to the air heat exchanger 13 to cool the air and then be discharged.

The air heating device 10 may include an expansion tank part 15. The expansion tank part 15 may include an expansion tank 151 and other components related to the expansion tank 151. Water may be stored in the expansion tank 151. Water may be replenished from an external water source to the expansion tank 151 through the water replenishment passage 153, and the water replenishment passage 153 may be controlled to open and close by the water replenishment valve 154. The expansion tank 151 may be provided to accommodate a volume change due to a change in water temperature. The expansion tank 151 may be configured in an open manner to accommodate volume expansion by water.

The water may be introduced from the expansion tank 151 into the air heat exchanger 13 via the water heater 12 through the furnace main passage 11. The water passing through the air heat exchanger 13 may be returned to the expansion tank 151 through the furnace main passage 11.

A water level sensor 152 that detects a water level inside the expansion tank 151 may be disposed in the expansion tank 151. When the water level sensor 152 confirms that the water level in the expansion tank 151 is below a predetermined water level, the water replenishment valve 154 may be opened to replenish water in the expansion tank 151.

A drain tube 155 may be disposed in the expansion tank 151 to reduce the water level by draining water when the water level in the expansion tank 151 is too high.

Since the water discharged from the expansion tank 151 contains foreign substances, a strainer (not shown) may be disposed to filter the foreign substances. The water discharged from the expansion tank 151 may be transferred to the water heater 12 through the strainer.

A circulation pump 18 may be disposed in the furnace main passage 11. The circulation pump 18 may be disposed in a region disposed between the expansion tank 151 and the water heater 12 in the furnace main passage 11. The circulation pump 18 may pump water so that the water is circulated within the furnace main passage 11. The circulation pump 18 may be electrically connected to the processor.

The water heater 12 may be a component that heats inflow water and discharges the water. To heat water, the water heater 12 may cause a combustion reaction and transfer the heat generated from the combustion reaction to the water.

The water heater 12 may include a burner 121 and an indoor heat exchange part 122. The burner 121 causes the combustion reaction. Therefore, the burner 121 may receive a fuel and air and may cause the combustion reaction to generate flame in a mixture of the fuel and air using a spark plug. For this operation, the burner 121 may include a blower that supplies air, a fuel nozzle that injects a fuel, and a spark plug that generates spark for ignition.

The burner 121 may further include a mixing chamber to allow the fuel and air to be mixed in the mixing chamber. Heat and a combustion gas may be generated through the combustion reaction and then may be transferred to water. The fuel may be a natural gas used for power generation such as methane, ethane, etc., or may be oil, but the type is not limited thereto. The flame generated by the combustion reaction generated by the burner 121 may be disposed in an internal space of a combustion chamber disposed below the burner 121. The combustion chamber may be a wet-type combustion chamber. For example, a water pipe through which water passes may be disposed on a side surface of the combustion chamber to surround the side surface of the combustion chamber. In a process of dissipating heat inside the combustion chamber to the outside of the combustion chamber, some of the heat may be transferred to the water in the water pipe. The combustion chamber may be a dry-type combustion chamber surrounded by an insulator.

The indoor heat exchange part 122 may transfer heat generated from the burner 121 to water. The indoor heat exchange part 122 may be provided in a fin-tube type including a pipe-type water heating heat exchange tube connected to the furnace main flow path 11 through which water passes, and a heat-exchange housing that defines a space through which the combustion gas generated by the combustion reaction passes through the outside of a water heating heat exchange pipe. However, the indoor heat exchange part 122 is not limited to this and may be provided in a plate type.

The indoor heat exchange part 122 may include a sensible heat exchange part and a latent heat exchange part. The sensible heat exchange part may be a portion that heats the water by receiving radiant heat generated by the combustion reaction and heat of the combustion gas, and the latent heat exchange part may be a portion that heats the water using latent heat of condensation of the combustion gas.

An upstream water temperature sensor 161 and a downstream water temperature sensor 162 may be disposed at upstream and downstream of the water heater 12, respectively, on the water heating passage 112 of the furnace main passage 11 to acquire a temperature of water introduced into the water heater 12 and a temperature of discharged water. A water heating flow sensor 163 may be disposed to acquire a flow rate of the water introduced in the water heating passage 112 on the water heating passage 112. The water heating flow sensor 163 may be disposed upstream of the water heater 12 on the water heating passage 112.

The air heat exchanger 13 may exchange heat between the water and air. The air heat exchanger 13 may receive heated water from the water heater 12 to be heat-exchanged with air to be discharged for the heating. The air heat exchanger 13 may include an air heating heat exchange tube through which water heated by the water heater 12 flows. The air heating heat exchange tube may be provided in a pipe shape so that water flows through the inside, and air supplied by the furnace fan 14 flows through the outside, and may be provided to provide a winding passage in the front-back and left-right directions. The air heating heat exchange pipe may be made of a material containing aluminum and copper.

The air heating device 10 may include a furnace fan 14. The furnace fan 14 may be provided to supply air to the air heat exchanger 13. The furnace fan 14 includes components such as a motor and a blade and may be electrically connected to the processor. Therefore, as the furnace fan 14 is electrically controlled to operate, the motor may allow the blade to rotate so that air is blown. The furnace fan 14 may include an impeller and the like to forcibly transfer air. External air may be transferred to the furnace fan 14 through a furnace supply port defined in the furnace case 100.

The air circulation process during the heating with respect to the furnace fan 14 is as follows. Air introduced into the furnace fan 14 may be transferred to the air heat exchanger 13. The supplied air may pass through the air heat exchanger 13. As the air passes through the air heat exchanger 13, the air may be heated by receiving heat from the water passing through the air heat exchanger 13. The heated air may be transferred to each room of a house H through a discharge duct. The inflow air, which is air transferred to each room and returned to the heating system may be introduced again into the furnace fan 14 through a suction duct. The suction duct may be provided to communicate with the room. During the cooling, there is only a difference in that the supplied air is cooled by the air heat exchanger 13.

The furnace main passage 11 may include a furnace passage 111, a water heating passage 112, and an intermediate heat exchange passage 113. The furnace passage 111 may pass through the air heat exchanger 13. Thus, the furnace passage 111 may transfer water to the air heat exchanger 13 to heat or cool the air. The furnace passage 111 may transfer water passing through the air heat exchanger 13 again to the expansion tank 151.

The water heating passage 112 may be branched from one end of the furnace passage 111 to pass through the water heater 12. Thus, when the water heater 12 operates, the water passing through the water heating passage 112 may be heated by the water heater 12. One end of the water heating passage 112 may be connected to one end of the furnace passage 111.

The intermediate heat exchange passage 113 may include an intermediate heat exchange inflow passage 1131 and an intermediate heat exchange discharge passage 1132. The intermediate heat exchange inflow passage 1131 may be separated from one end of the furnace passage 111 and connected to the intermediate heat exchanger 30. That is, the intermediate heat exchange inflow passage 1131 may transfer water flowing in the furnace passage 111 to the intermediate heat exchanger 30. The intermediate heat exchange discharge passage 1132 may have one end connected to the intermediate heat exchanger 30 and the other end connected to the other end of the furnace passage 111. The other end of the water heating passage 112 may also be connected to the other end of the furnace passage 111. That is, the water heating passage 112 may be combined with the other end of the intermediate heat exchange discharge passage 1132 at the other end of the furnace passage 111. Thus, the intermediate heat exchange discharge passage 1132 may transfer the water passing through the intermediate heat exchanger 30 to the air heat exchanger 13 through the furnace passage 111.

As described above, the water flowing in the furnace passage 111 may pass through the water heating passage 112 and the intermediate heat exchange passage 113 so as to be heated or cooled and then may be transferred back to the furnace passage 111 and transferred to the air heat exchanger 13 to heat or cool the air.

The air heating device 10 may include a water heating flow control valve 171. The water heating flow control valve 171 may be disposed in the water heating passage 112 to control a flow rate of water flowing in the water heating passage 112. The water heating flow control valve 171 may be disposed at the downstream side of the water heater 12 in the water heating passage 112. The water heating flow control valve 171 may be disposed downstream of the downstream water temperature sensor 162.

An intermediate heat exchange flow sensor 164 may be disposed on the intermediate heat exchange passage 113 to acquire a flow rate of water flowing in the intermediate heat exchange passage 113. The intermediate heat exchange flow sensor 164 may be disposed in the intermediate heat exchange inflow passage 1131.

An intermediate heat exchange valve 172 may be disposed on the intermediate heat exchange passage 113 to control a flow of water in the intermediate heat exchange passage 113. The intermediate heat exchange valve 172 may be a flow control valve or a solenoid valve that is opened and closed as power is supplied. The intermediate heat exchange valve 172 may be electrically connected to the processor.

Intermediate Heat Exchanger (30)

The intermediate heat exchanger 30 may heat-exchange a refrigerant flowing in the heat pump 20 with water flowing in the air heating device 10. The intermediate heat exchanger 30 may receive the refrigerant sequentially passing through the expansion valve 24, the outdoor heat exchanger 221, and the compressor 23 in the heating mode from the heat pump 20. The intermediate heat exchanger 30 may receive the refrigerant sequentially passing through the compressor 23, the outdoor heat exchanger 221, and the expansion valve 24 in the cooling mode from the heat pump 20. The intermediate heat exchanger 30 may receive water through the intermediate heat exchange inflow passage 1131 of the air heating device 10.

The intermediate heat exchanger 30 may exchange heat with the transferred water. The intermediate heat exchanger 30 may function as a condenser when performing the heating and as an evaporator when performing the cooling for the refrigerant. When the refrigerant passing through the intermediate heat exchanger 30 performs the heating, the refrigerant may be condensed to transfer latent heat to the water passing through the intermediate heat exchanger 30. When the refrigerant passing through the intermediate heat exchanger 30 performs the cooling, the refrigerant may be evaporated to take heat out of the water passing through the intermediate heat exchanger 30.

The intermediate heat exchanger 30 may include an intermediate heat exchange part 31 in which heat exchange occurs. The intermediate heat exchanger 31 may be a plate-type heat exchanger. The intermediate heat exchange part may be a fin-tube type heat exchanger, and the type is not limited thereto as long as heat exchange is possible.

The intermediate heat exchanger 30 may include an intermediate heat exchange refrigerant passage 33 connected to the intermediate heat exchange part 31 to transfer the refrigerant to the intermediate heat exchange part 31 and discharge the refrigerant from the intermediate heat exchange part 31. The intermediate heat exchanger 30 may include an intermediate heat exchange water passage 32 connected to the intermediate heat exchanger 31 to transfer the water to the intermediate heat exchanger 31 and discharges the water from the intermediate heat exchanger 31.

The intermediate heat exchanger 30 may be disposed so that the water flowing in the air heating device 10 and the refrigerant flowing in the heat pump 20 exchange heat with each other. Therefore, the water flowing in the air heating device 10 may be heated using not only the water heater 12 but also the intermediate heat exchanger 30, and the heated water may be transferred to the air heat exchanger 13 to heat the water. Thus, in some cases, the entire air conditioning system 1 may be controlled to have optimal heating efficiency by appropriately distributing the heating load to the heat pump 20 and the water heater 12.

In addition, since the water in the air heating device 10 may not only be heated but also cooled using the refrigerant, it may also be possible to perform the cooling through the air heat exchanger 13.

In addition, the flow rate of water flowing into the water heating passage 112 and the intermediate heat exchange passage 113 may be adjusted using the water heating flow control valve 171 and/or the intermediate heat exchange valve 172, and thus, when the heat pump 20 is returned from the defrost mode, the flow rate of the water flowing into the intermediate heat exchange passage 113 may be significantly lowered to prevent the compressor 23 from being damaged as the refrigerant is overheated to flow into the compressor 23.

Processor

The air conditioning system 1 according to an embodiment of the present invention may further include a controller. The controller may include a processor and a memory. The processor may be electrically connected to the heat pump 20 and the air heating device 10 to control the heat pump 20 and the air heating device 10 so as to operate according to a heating mode, a cooling mode, and other modes. The processor may be a component including elements capable of logical operations that perform a control command and may include a central processing unit (CPU). The processor may be connected to various components to perform the control by transmitting a signal according to the control command to each component and may be connected to various sensors or acquisition units to receive acquired information in the form of signals. Thus, in an embodiment of the present invention, the processor may be electrically connected to various components provided in the air conditioning system 1. Since the processor is electrically connected to each component, a communication module connected through a conductive wire or capable of wireless communication may be further provided so that the processor communicates with the components.

The control command performed by the processor may be stored in the memory and utilized. The memory may be a storage device such as a hard disk drive (HDD), a solid state drive (SSD), a server, a volatile media, or a non-volatile media, but the type is not limited thereto. In addition, data necessary for the processor to perform the operation may be stored in the memory.

The processor may control the air conditioning system 1 according to the defrost mode. In the defrost mode, the processor may control the heat pump 20 to operate for the cooling and the air heating device 10 to operate for the heating. Since the defrost mode is intended to remove frost generated on the outdoor heat exchange part 221 of the heat pump 20 in cold winters, the processor may allow the air conditioning system 1 to operate in the heating mode before and after the defrost mode.

When the defrost mode is finished, the processor may control the water heating flow control valve 171 so that a flow rate of water flowing into the intermediate heat exchange passage 113 is less than that of water flowing into the water heating passage 112. Therefore, when returning to the heating mode, the refrigerant may be introduced into the compressor 23 in a state of being overheated by the hot return water of the intermediate heat exchange passage 113 in the intermediate heat exchanger 30 to prevent the compressor 23 from being damaged.

A mapping table that maps optimal load distribution for each target heating load may be stored in the memory. According to this mapping table, the processor may distribute the load to control the water heater 12, the water heating flow control valve 171, and the heat pump 20. However, the processor may also calculate and use the mapping table using information received from various sensors and information stored in the memory. The optimal load distribution may be heating load distribution calculated to achieve the highest efficiency of the heating system based on a temperature of external air and a target heating load. The optimal load distribution may be determined based on a rate of fuel and a rate of electricity used by the heat pump 20.

When operating in the defrost mode, the processor may control the water heater 12 so that the water heater 12 receives more heating load than the heating load that is not processed by the heat pump 20. Thus, even though the heat pump 20 transfers cold refrigerant to the intermediate heat exchanger 30 to cool the water passing through the intermediate heat exchanger 30 in the defrost mode, uniform heating may be achieved. That is, the processor may control the water heater 12 to supplement an amount of heat from the water heater 12 to the extent that an amount of heat transferred to the air decreases due to the defrost operation of the heat pump 20.

Case and Adapter

The air conditioning system 1 according to the first embodiment of the present invention may include a furnace case 100. The furnace case 100 may include the air heating device 10 and the intermediate heat exchanger 30 therein. The air conditioning system 1 may include a heat pump case 200. The heat pump case 200 may include a heat pump 20.

The air conditioning system 1 may include a connection tube 40. The connection tube 40 may be a tube that connects the heat pump 20 to the intermediate heat exchanger 30 so that the refrigerant flows. Since the refrigerant has to be circulated, the connection tubes 40 may be provided in a pair.

The air conditioning system 1 may include a furnace adapter 101. The furnace adapter 101 may be an adapter which is installed in the furnace case 100 and is connected to the intermediate heat exchanger 30 and to which the connection tube 40 is separably connected. Since the connection tube 40 is provided in the pair, the furnace adapter 101 may be provided in a pair.

The air conditioning system 1 may include an internal adapter 102. The internal adapter 102 may be an adapter that connects the intermediate heat exchange water passage 32 to the intermediate heat exchange passage 113 of the intermediate heat exchanger 30 inside the furnace case 100. The intermediate heat exchange water passage 32 and the intermediate heat exchange passage 113 may be separably connected by the internal adapter 102. Since water has to be circulated, the internal adapter 102 may be provided in a pair.

The air conditioning system 1 may include a heat pump adapter 201. The heat pump adapter 201 may be an adapter which is installed in the heat pump case 200 and is connected to the heat pump main passage 21 and to which the connection tube 40 is separably connected. Since the connection tube 40 is provided in the pair, the heat pump adapter 201 may be provided in a pair.

Second Embodiment

Figure 3:
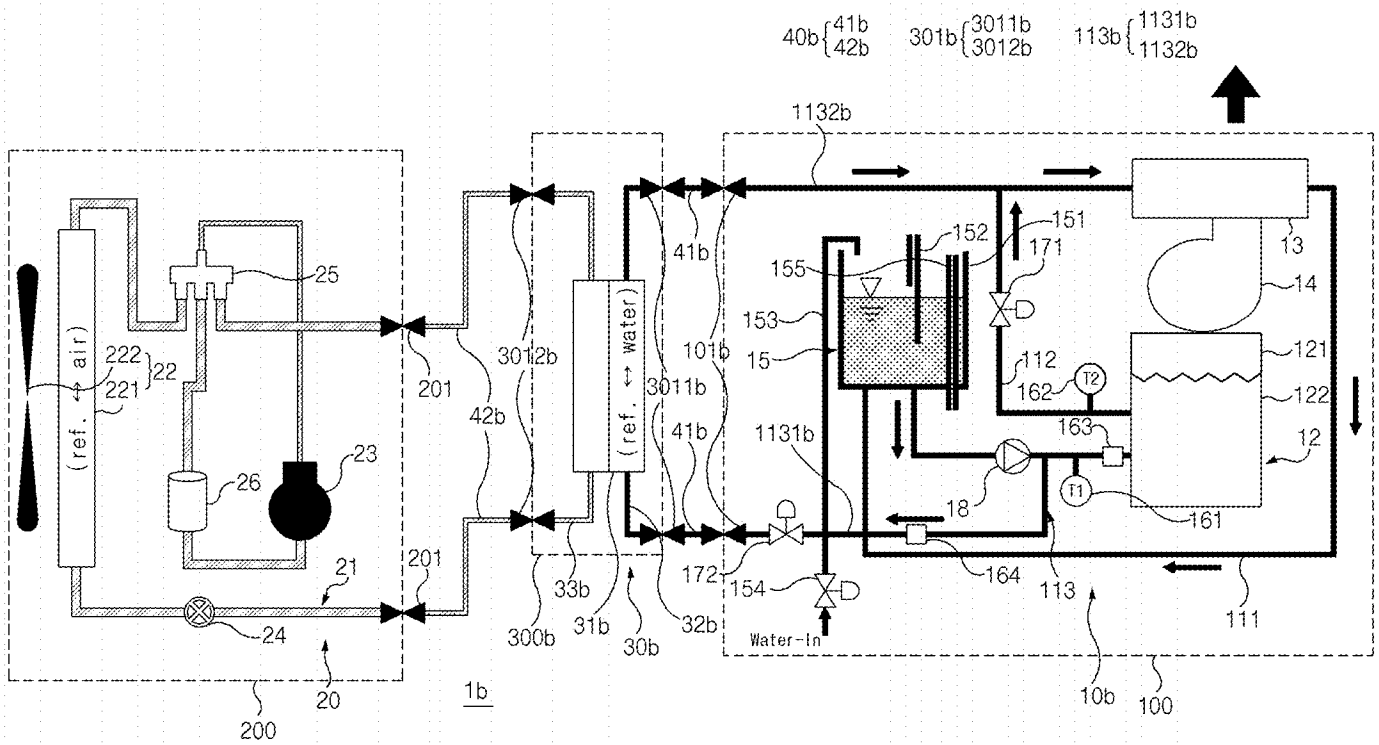
FIG. 3 is a conceptual view of an air conditioning system according to a second embodiment of the present invention.

FIG. 3 is a conceptual view of an air conditioning system 1*b* according to a second embodiment of the present invention.

The air conditioning system 1*b* according to the second embodiment of the present invention may be similar to that according to the first embodiment of the present invention, except that an intermediate heat exchanger 30*b* is disposed outside a furnace case 100*b* and further includes related components. Thus, differences will be further explained, and descriptions of portions that are the same as those of the air conditioning system 1 according to the first embodiment of the present invention may be applied as they are.

The furnace case 100*b* of the air conditioning system 1*b* according to the second embodiment of the present invention may be provided with an air heating device 10*b*. However, the intermediate heat exchanger 30*b* may be disposed outside the furnace case 100*b*.

The air conditioning system 1*b* according to the second embodiment of the present invention includes an intermediate heat exchange case 300*b*. The intermediate heat exchange case 300*b* may be provided with an intermediate heat exchanger 30*b*.

The connection tube 40*b* according to the second embodiment of the present invention includes a heat pump connection tube 42*b* and an air heating connection tube 41*b*. The heat pump connection tube 42*b* may connect the heat pump 20 to the intermediate heat exchanger 30*b* so that a refrigerant flows. The air heating connection tube 41*b* may connect the air heating device 10*b* to the intermediate heat exchanger 30*b* so that water flows. Since the water and refrigerant have to be circulated, each of the air heating connection tube 41*b* and the heat pump connection tube 42*b* may be provided in a pair.

The air conditioning system 1*b* includes an intermediate heat exchange adapter 301*b*. The intermediate heat exchange adapter 301*b* may be an adapter which is installed in the intermediate heat exchange case 300*b* and to which the connection tube 40*b* is separably connected. Therefore, the intermediate heat exchange adapter 301*b* may include an intermediate heat exchange adapter 3011*b* connected to the air heating connection tube 41*b* and an intermediate heat exchange water passage 32*b* and an intermediate heat exchange refrigerant adapter 3012*b* connected to the heat pump connection tube 42*b* and an intermediate heat exchange refrigerant passage 33*b* and may be provided in a pair.

The furnace adapter 101*b* may be connected to the intermediate heat exchange inflow passage 1131*b* and the intermediate heat exchange discharge passage 1132*b* of the air heating device 10*b*, and the air heating connection tube 41*b* may be separably connected to the furnace adapter 101*b*.

The heat pump adapter 201 may be connected to the heat pump main passage 21, and the heat pump connection tube 42*b* may be separably connected to the heat pump adapter 201.

As in the second embodiment of the present invention, the intermediate heat exchanger 30*b* may be disposed separately from the air heating device 10*b* and be separably connected to the heat pump 20 and the air heating device 10*b*, and thus, each components of the air conditioning system 1*b* may be easily replaced and repaired.

Third Embodiment

Figure 4:
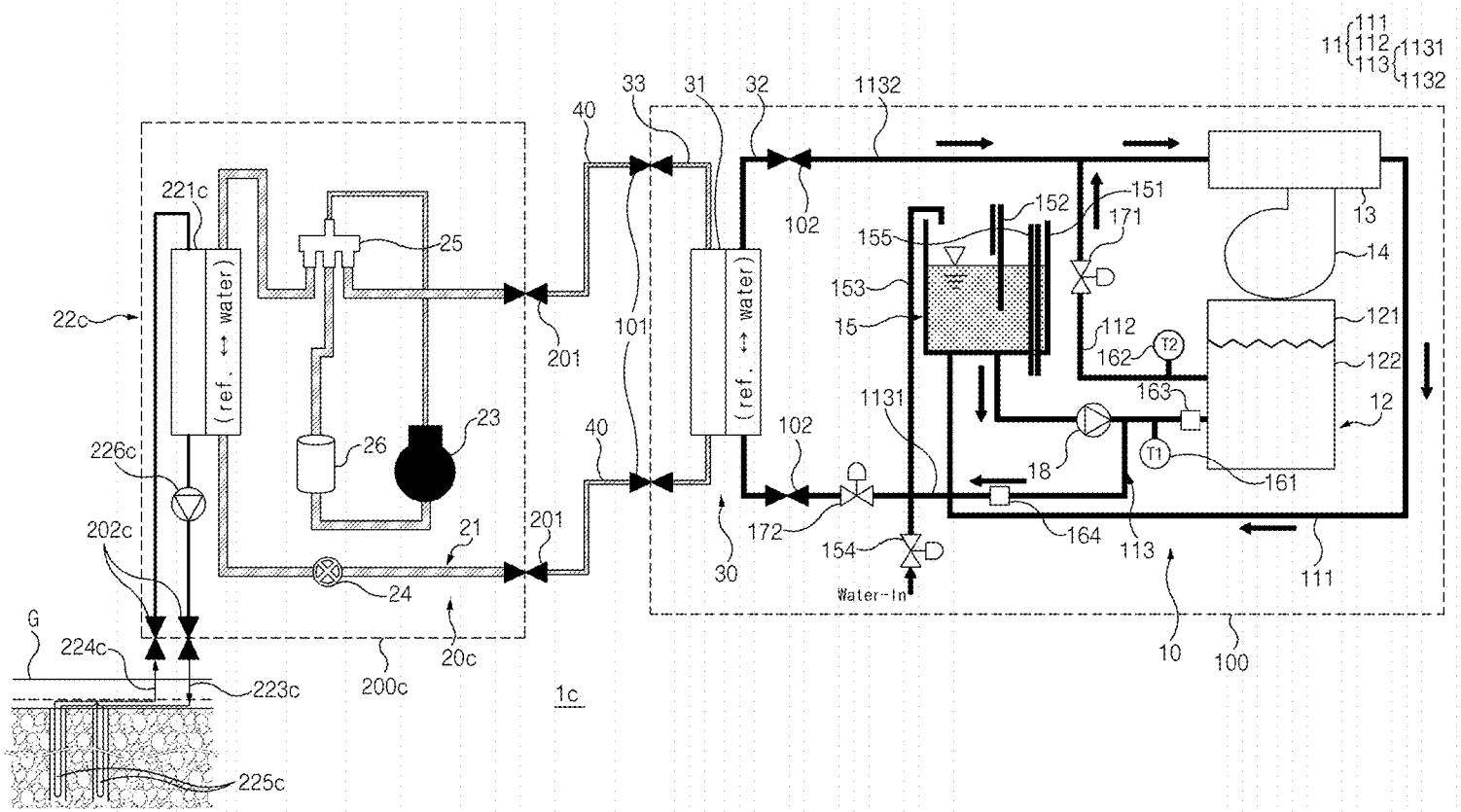
FIG. 4 is a conceptual view of an air conditioning system according to a third embodiment of the present invention.

FIG. 4 is a conceptual view of an air conditioning system 1*c* according to a third embodiment of the present invention.

The air conditioning system 1*c* according to the third embodiment of the present invention may be the same as that according to the first embodiment of the present invention, except that an outdoor heat exchange module 22*c* is provided as a geothermal heat exchanger. Thus, differences will be further explained, and descriptions of portions that are the same as those of the air conditioning system 1 according to the first embodiment of the present invention may be applied as they are.

The outdoor heat exchange module 22*c* of the heat pump 20*c* according to the third embodiment of the present invention may be provided to exchange heat between a refrigerant and the outside. The outdoor heat exchange module 22*c* may include an outdoor heat exchange part 221*c* through which the refrigerant flows, but the outdoor fan 222 (see FIG. 2) may not be disposed. Instead, an auxiliary refrigerant cooled or heated in the ground, which is an area below the ground G, may further flow into the outdoor heat exchange part 221*c* to cool or heat the refrigerant. The auxiliary refrigerant may be water.

For this, the outdoor heat exchange module 22*c* may include an outdoor discharge passage 223*c* and an outdoor inflow passage 224*c* and also may include an underground heat exchange part 225*c* buried in the ground below the ground G. The underground heat exchange part 225*c* may be provided as a plurality of tubes extending in a vertical direction as a unit. The auxiliary refrigerant may be discharged from the outdoor heat exchange part 221*c* through the outdoor discharge passage 223*c*, be cooled or heated in the underground heat exchange part 225*c* under an influence of a temperature maintained that is relatively constant in the ground, and be returned to the outdoor heat exchange part 221*c* through the outdoor inflow passage 224*c*. An outdoor pump 226*c* for pumping the auxiliary refrigerant may be disposed in a passage connecting the outdoor heat exchange part 221*c* to the outdoor discharge passage 223*c*. An outdoor adapter 202*c* may be provided on in the heat pump case 200*c* so that the passage extending from the outdoor heat exchange part 221*c*, the outdoor discharge passage 223*c*, and the outdoor inflow passage 224*c* are separably connected to each other.

All components may be coupled to one another to form a single body or to operate as a single body, but the present disclosure is not limited thereto. That is, one or more components are selectively coupled and operated within the scope of the present disclosure. The terms "comprising," "including," and "having," as used in the claims and specification herein, shall be considered as indicating an open group that may include other elements not specified. Unless terms used in the present disclosure are defined differently, the terms may be construed as meaning known to those skilled in the art. Terms such as terms that are generally used and have been in dictionaries should be construed as having meanings matched with contextual meanings in the art. In this description, unless defined clearly, terms are not ideally, excessively construed as formal meanings.

Therefore, according to the present invention, the air heating device and the heat pump may properly operate to prevent the heat pump from being damaged and perform the stable heating.

The above-disclosed subject matter is to be considered illustrative, and not restrictive, and the appended claims are intended to cover all such modifications, enhancements, and other embodiments, which fall within the true spirit and scope of the present invention. Thus, the embodiment of the present invention is to be considered illustrative, and not restrictive, and the technical spirit of the present invention is not limited to the foregoing embodiment. Therefore, the scope of the present invention is defined not by the detailed description of the invention but by the appended claims, and all differences within the scope will be construed as being included in the present invention.

What is claimed is:

1. An air conditioning system comprising:

a heat pump provided to heat or cool a circulating refrigerant;

an air heating device provided to burn a fuel so as to heat circulating water so that air is heated by the heated water;

an intermediate heat exchanger provided to exchange heat between the refrigerant and the water, a water heating flow control valve disposed in the water heating passage to control a flow rate of the water flowing in the water heating passage, and a processor electrically connected to the heat pump and the air heating device, wherein the air heating device comprises:

a water heater provided to receive heat from a combustion gas generated by combustion reaction so as to heat the water;

an air heat exchanger provided to receive the water heated by the water heater so as to exchange heat with the air to be discharged for the heating; and a furnace main passage provided to circulate the water, wherein the furnace main passage comprises:

a furnace passage passing through the air heat exchanger;

a water heating passage branched from one end of the furnace passage to pass through the water heater; and an intermediate heat exchange passage provided with an intermediate heat exchange inflow passage branched from one end of the furnace passage and connected to the intermediate heat exchanger and an intermediate heat exchange discharge passage having one end connected to the intermediate heat exchanger, and wherein the processor is configured to control the water heating flow control valve so that a flow rate of the water flowing in the intermediate heat exchange passage is less than that of the water flowing in the water heating passage when a defrost mode, in which the heat pump operates for the cooling, and the air heating device operates for the heating, is finished.

2. The air conditioning system of claim 1, wherein the other end of the intermediate heat exchange discharge passage and the water heating passage are combined with each other at the other end of the furnace passage.

3. The air conditioning system of claim 1, wherein the heat pump comprises an outdoor heat exchange module provided to exchange heat between the refrigerant and the outside, wherein the outdoor heat exchange module comprises an outdoor heat exchange part through which the refrigerant flows.

4. The air conditioning system of claim 3, wherein the outdoor heat exchange module further comprises an outdoor fan provided to generate a flow of air to the outdoor heat exchange part.

5. The air conditioning system of claim 1, wherein the heat pump comprises:

an expansion valve provided to expand the refrigerant;

an outdoor heat exchange part provided to exchange heat between the refrigerant and external air; and a compressor provided to compress the refrigerant, wherein the intermediate heat exchanger is configured to receive the refrigerant sequentially passing through the expansion valve, the outdoor heat exchanger, and the compressor in a heating mode.

6. The air conditioning system of claim 5, wherein the intermediate heat exchanger is configured to receive the refrigerant sequentially passing through the compressor, the outdoor heat exchanger, and the expansion valve in a cooling mode.

7. The air conditioning system of claim 1, further comprising a furnace case provided with the air heating device and the intermediate heat exchanger.

8. The air conditioning system of claim 7, further comprising:

a connection tube configured to connect the heat pump to the intermediate heat exchanger so that the refrigerant flows; and a furnace adapter which is installed in the furnace case and connected to the intermediate heat exchanger and to which the connection tube is separably connected.

9. An air conditioning system comprising:

a heat pump provided to heat or cool a circulating refrigerant;

an air heating device provided to burn a fuel so as to heat circulating water so that air is heated by the heated water;

a furnace case provided with the air heating device;

an intermediate heat exchanger disposed outside the furnace case and provided to exchange heat between the refrigerant and the water, a water heating flow control valve disposed in the water heating passage to control a flow rate of the water flowing in the water heating passage, and a processor electrically connected to the heat pump and the air heating device, wherein the air heating device comprises:

a water heater provided to receive heat from a combustion gas generated by combustion reaction so as to heat the water;

an air heat exchanger provided to receive the water heated by the water heater so as to exchange heat with the air to be discharged for the heating; and a furnace main passage provided to circulate the water, wherein the furnace main passage comprises:

a furnace passage passing through the air heat exchanger;

a water heating passage branched from one end of the furnace passage to pass through the water heater; and an intermediate heat exchange passage provided with an intermediate heat exchange inflow passage branched from one end of the furnace passage and connected to the intermediate heat exchanger and an intermediate heat exchange discharge passage having one end connected to the intermediate heat exchanger, and wherein the processor is configured to control the water heating flow control valve so that a flow rate of the water flowing in the intermediate heat exchange passage is less than that of the water flowing in the water heating passage when a defrost mode, in which the heat pump operates for the cooling, and the air heating device operates for the heating, is finished.

10. The air conditioning system of claim 9, wherein the other end of the intermediate heat exchange discharge passage and the water heating passage are combined with each other at the other end of the furnace passage.

11. The air conditioning system of claim 9, wherein the heat pump comprises an outdoor heat exchange module provided to exchange heat between the refrigerant and the outside, wherein the outdoor heat exchange module comprises an outdoor heat exchange part through which the refrigerant flows.

12. The air conditioning system of claim 11, wherein the outdoor heat exchange module further comprises an outdoor fan provided to generate a flow of air to the outdoor heat exchange part.

13. The air conditioning system of claim 9, wherein the heat pump comprises:

an expansion valve provided to expand the refrigerant;

an outdoor heat exchange part provided to exchange heat between the refrigerant and external air; and a compressor provided to compress the refrigerant, wherein the intermediate heat exchanger is configured to receive the refrigerant sequentially passing through the expansion valve, the outdoor heat exchanger, and the compressor in a heating mode.

14. The air conditioning system of claim 13, wherein the intermediate heat exchanger is configured to receive the refrigerant sequentially passing through the compressor, the outdoor heat exchanger, and the expansion valve in a cooling mode.

15. The air conditioning system of claim 9, further comprising:

a heat pump connection tube configured to connect the heat pump to the intermediate heat exchanger so that the refrigerant flows;

an air heating connection tube configured to connect the air heating device to the intermediate heat exchanger so that the water flows;

an intermediate heat exchange case provided with the intermediate heat exchanger; and a plurality of intermediate heat exchange adapter which is installed in the intermediate heat exchange case and connected to the intermediate heat exchanger and to which the heat pump connection tube or the air heating connection tube are separably connected.

16. The air conditioning system of claim 9, further comprising:

a heat pump connection tube configured to connect the heat pump to the intermediate heat exchanger so that the refrigerant flows;

an air heating connection tube configured to connect the air heating device to the intermediate heat exchanger so that the water flows;

a heat pump case provided with the heat pump;

a furnace adapter which is installed in the furnace case and connected to the air heating device and to which the air heating connection tube is separably connected; and a heat pump adapter which is installed in the heat pump case and connected to the heat pump and to which the heat pump connection tube is separably connected.

* * * * *